US007806159B2

(12) United States Patent
Rossato et al.

(10) Patent No.: US 7,806,159 B2
(45) Date of Patent: Oct. 5, 2010

(54) FLEXIBLE WINDOW COVERING

(75) Inventors: Alejandro Martin Rossato, Greensboro, NC (US); Vincent A. Monfalcone, III, Greensboro, NC (US)

(73) Assignee: Newell Window Furnishings, Inc., High Point, NC (US)

( * ) Notice: Subject to any disclaimer, the term of this patent is extended or adjusted under 35 U.S.C. 154(b) by 225 days.

(21) Appl. No.: 12/044,515

(22) Filed: Mar. 7, 2008

(65) Prior Publication Data

US 2008/0230189 A1 Sep. 25, 2008

Related U.S. Application Data

(60) Provisional application No. 60/919,052, filed on Mar. 20, 2007.

(51) Int. Cl.
*E06B 3/48* (2006.01)

(52) U.S. Cl. ..... 160/84.01; 160/115; 160/126

(58) Field of Classification Search ..... 160/84.01, 160/84.03, 123, 126, 87, 89, 113, 114, 115, 160/119
See application file for complete search history.

(56) References Cited

U.S. PATENT DOCUMENTS 4,813,468 A * 3/1989 Fraser ..... 160/84.03
4,953,610 A * 9/1990 Phillips et al. ..... 160/84.03
5,341,864 A * 8/1994 Rupel et al. ..... 160/84.03
5,566,736 A 10/1996 Crider et al.
5,785,105 A 7/1998 Crider et al.
6,591,887 B1 * 7/2003 Hsu ..... 160/84.03
6,662,845 B1 * 12/2003 Palmer ..... 160/84.01
6,923,236 B2 * 8/2005 Lin ..... 160/84.01
2005/0155722 A1 7/2005 Colson et al.
2006/0225845 A1 * 10/2006 Marusak et al. ..... 160/126
2008/0035277 A1 * 2/2008 Lin ..... 160/84.03
2008/0230189 A1 * 9/2008 Rossato et al. ..... 160/115

OTHER PUBLICATIONS

Canadian Intellectual Property Office, First Office Action, Mar. 8, 2010.

* cited by examiner

*Primary Examiner*—Blair M. Johnson
(74) *Attorney, Agent, or Firm*—Dennis J. Williamson; Moore & Van Allen, PLLC

(57) ABSTRACT

A window covering having a flexible panel and a first lift cord for raising the flexible panel. A second panel is at least partially coextensive with the flexible panel and a second lift cord is provided for raising the second panel. The flexible panel may have an upper edge and a lower edge where the upper edge is connected to a head rail and the lower edge is disposed below the head rail. The second lift cord may raise the upper edge of the second panel. In one embodiment a third panel at least partially coextensive with a portion of the flexible panel and a third lift cord for raising the top edge of the third panel are provided. The light blocking characteristic of the blind is changed by the placement of the panels.

30 Claims, 4 Drawing Sheets

FLEXIBLE WINDOW COVERING

This application claims the benefit of priority under 35 U.S.C. §119(e) to the filing date of U.S. Provisional Application 60/919,052 filed on Mar. 20, 2007, which is incorporated herein by reference in its entirety.

BACKGROUND OF THE INVENTION

The invention relates generally to cordless window coverings and more particularly to cordless window coverings having relatively soft, flexible panels.

Window coverings having flexible shade panels such as woven wood shades, natural shades, Roman shades, hobbled shades, looped shades, and the like are known. Because of the construction of the shade panel such shades typically are light permeable. For example, the flexible panel of a woven shade may comprise a plurality of horizontal members constructed of bamboo, faux bamboo, or the like connected together by woven cords. Natural shades may comprise a plurality of horizontally extending fabric pieces loosely woven with a plurality of vertically extending woven pieces. Such shades typically allow some light to pass through the shade through the spaces or gaps in the woven material. While such shades provide an aesthetically pleasing window covering, in some applications the user may desire the appearance of a woven shade with a window covering that provides greater light filtering or blocking characteristics.

Day/night shades are also known. One type of day night shade comprises a pleated shade panel where the top portion of the shade has a first light blocking/filtering ability and the bottom portion of the shade has a second light blocking/filtering ability. The shade can be raised to expose the bottom portion of the shade or lowered to expose the top portion of the shade.

SUMMARY OF THE INVENTION

One embodiment of the window covering comprises a window covering having a flexible panel and a first lift cord for raising the flexible panel. A second panel is at least partially coextensive with the flexible panel and a second lift cord is provided for raising the second panel. The flexible panel may have an upper edge and a lower edge where the upper edge is connected to a head rail and the lower edge is disposed below the head rail. The second lift cord may raise the upper edge of the second panel. In one embodiment a third panel at least partially coextensive with a portion of the flexible panel and a third lift cord for raising the top edge of the third panel are provided. In this embodiment the second panel has a first light blocking characteristic and the third panel has a second light blocking characteristic.

DETAILED DESCRIPTION OF EMBODIMENTS OF THE INVENTION

Figure 2:
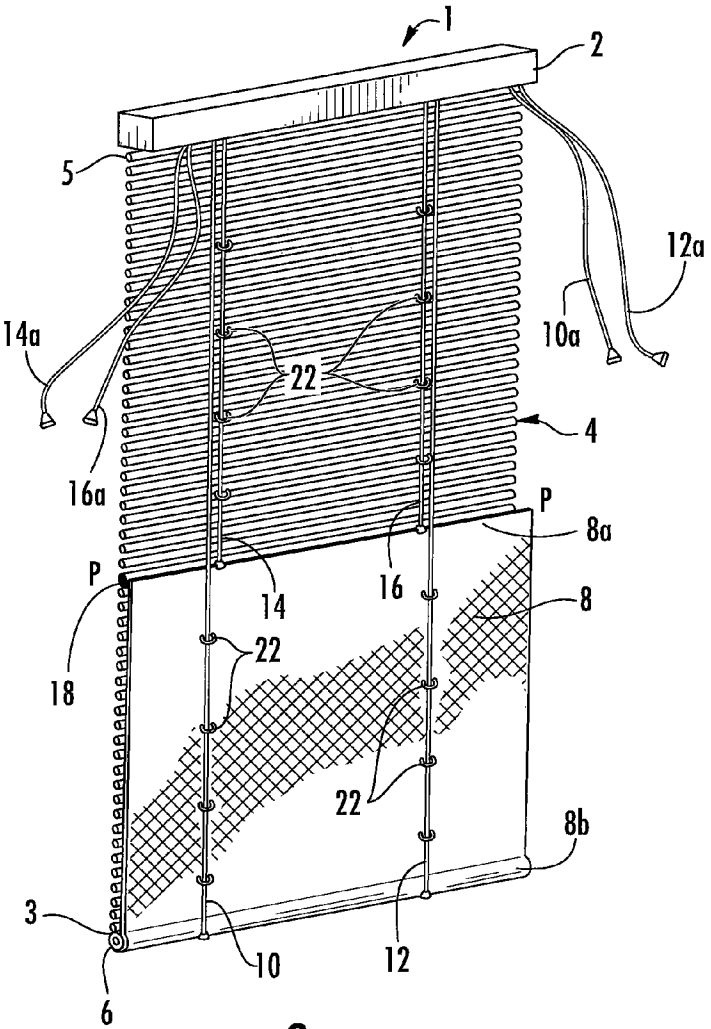
FIG. 2 is a back perspective view of the embodiment of the window covering of FIG. 1.
Figure 1:
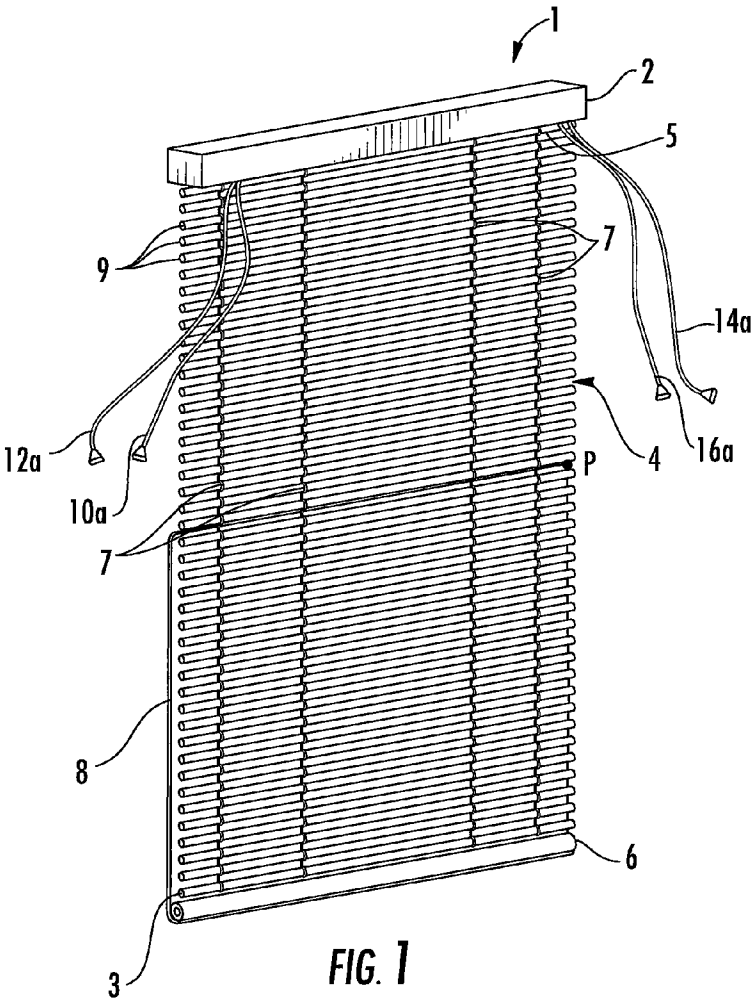
FIG. 1 is a front perspective view of an embodiment of the window covering of the invention.

The window covering is shown generally at 1 in the illustrations and comprises a head rail 2 supporting the upper edge 5 of a flexible shade panel 4 and may have a bottom rail 6 located at the lower edge 3 of the panel 4. Either or both the head rail 2 and the bottom rail 6 may be covered in the shade panel fabric such that they are hidden from view. The flexible shade panel 4 may comprise woven wood shades, natural shades, Roman shades, hobbled shades, looped shades, or the like where the shade panel is made of a relatively flexible material. In the illustrated embodiment the shade panel 4 is a woven wood shade and comprises a plurality of horizontal members 9 constructed of bamboo, faux bamboo, reeds, grasses or the like connected together by woven cords 7. The shade panel 4 may also comprise a fabric panel made of a plurality of horizontal and vertical strips of fabric or other material woven to create the panel. The panel 4 is relatively soft such that it can be folded over itself or rolled when the shade panel is raised. Further, because the panel may be made of woven elements the panel is light permeable both through the materials of the shade and through the gaps between the various woven elements.

The head rail 2 and shade panel 4 are typically dimensioned to coincide with the dimensions of the architectural feature with which the window covering is intended to be used. While the invention is referred to as a window covering and may be used primarily to cover windows, it is to be understood that the invention may be used to cover any architectural feature such as a window, door, opening, alcove or the like.

The upper edge 5 of the panel 4 is secured to the head rail 2 such that the head rail extends for substantially the width of the panel 4. The head rail 2 may be comprised of a rigid material such as a wood, plastic or metal and may be formed as a solid member or may be formed as a hollow member such as a U-shaped member.

A second panel of material 8 is located on one side of the panel 4. In one embodiment the second panel is located on the back side of panel 4 such that it is hidden from view when the window covering is located on an architectural feature. The second panel of material 8 may be provided with particular light blocking/filtering characteristics. For example, the second panel 8 may be completely light blocking or it may be partially light blocking or light filtering. In the illustrated embodiments the second panel has a width that is substantially the same as the width of panel 4 and extends between the bottom rail 6 or lower edge 3 and a midpoint P of the panel 4. It is to be understood that the midpoint P does not necessarily constitute the exact center of the shade panel may be any point between the upper edge 5 and lower edge 3 of panel 4. In the illustrated embodiment panel 8 has an upper edge 8*a* secured to the panel 4 at midpoint P and a lower edge 8*b* secured at or near the lower edge 3 of panel 4.

Figure 8:
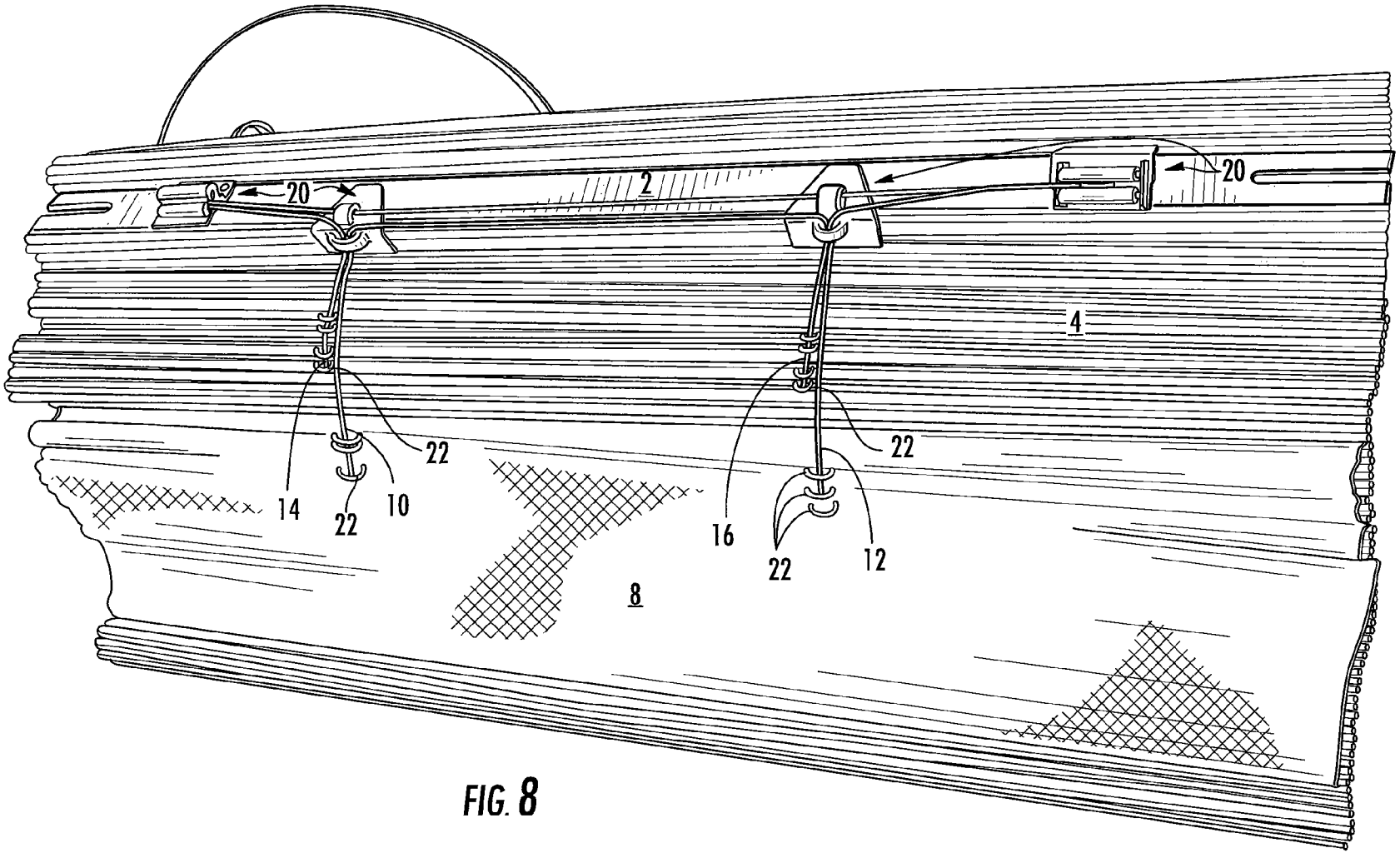
FIG. 8 is a back view of the embodiment of the window covering of FIG. 1 showing the head rail.

Lift cords 10 and 12 are connected adjacent to the bottom edge of panel 4 or to the bottom rail 6. The lift cords 10 and 12 extend from the bottom edge of panel 4 to the head rail 2 and pass across and/or through the head rail to form pull cord portions 10*a* and 12*a* that can be manipulated by the user to raise and lower the bottom edge of panel 4. In one alternate embodiment the lift cords extend from the bottom edge of panel 4 into the head rail 2 and pass through and out of the head rail to form pull cord portions 10*a* and 12*a*. It is to be understood that the lift cords may run through a pulley or roller system 20 that supports and guides the cords through the head rail (FIG. 8). Further, a cord lock may be provided to lock the lift cords, and the panel, in the desired position. The lift cords extend through rings 22 that are secured to the panel 8 to guide the lift cords and create the folded pleats 23 of the panels in the retracted or raised position.

Lift cords 14 and 16 are connected near a midpoint P of the panel 4. The lift cords 14 and 16 extend from the mid-point of panel 4 to the head rail 2 and pass across the head rail to form pull cord portions 14*a* and 16*a* that can be manipulated by the user to raise and lower the midpoint of panel 4. In one alternate embodiment the lift cords 14 and 16 extend from the mid-point of panel 4 into the head rail 2 and pass through and out of the head rail to form pull cord portions 14*a* and 16*a*. It is to be understood that the lift cords may run through a pulley or roller system that supports and guides the cords through the head rail as shown in FIG. 8. Further, a cord lock may be provided to lock the lift cords, and the panel, in the desired position.

A rail 18 may be provided at the midpoint P to support the center of panel 4 as it is raised by lift cords 14 and 16. Specifically, rail 18 may comprise a rigid member that extends between the side edges of panel 4. The rail may extend for the entire width of the panel 4 or it may extend for a slightly greater or lesser distance than the entire width of panel 4. The lift cords extend through rings 22 that are secured to the panel 4 to guide the lift cords and create the folded pleats 23 of the panel 4 in the retracted position.

Figure 3:
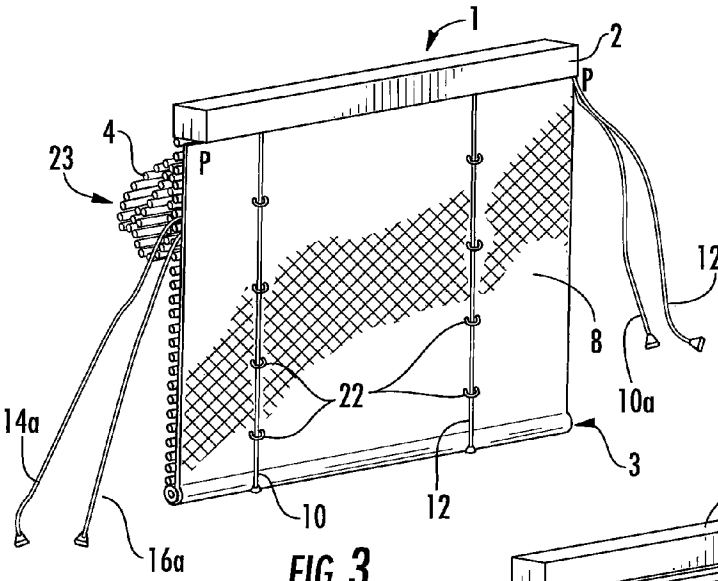
FIG. 3 shows the window covering of FIG. 1 in a first orientation.

To operate the window covering of the invention, the user may manipulate either or both lift cords 10, 12 and lift cords 14, 16 to vary the light blocking characteristics of the shade. For example a user may pull portions 14*a*, 16*a* to shorten the lift cords 14, 16 and raise the center of the shade as shown in FIG. 3. In this position, the portion of panel 4 with second panel 8 is located over the window or other architectural feature. Because second panel 8 may have light filtering or light blocking characteristics, the window covering 1, when in this position, can block or filter the light in a manner that is different than when only the panel 4 covers the window. In this position folded pleats 23 are formed in panel 4 near the top of the window covering.

Figure 4:
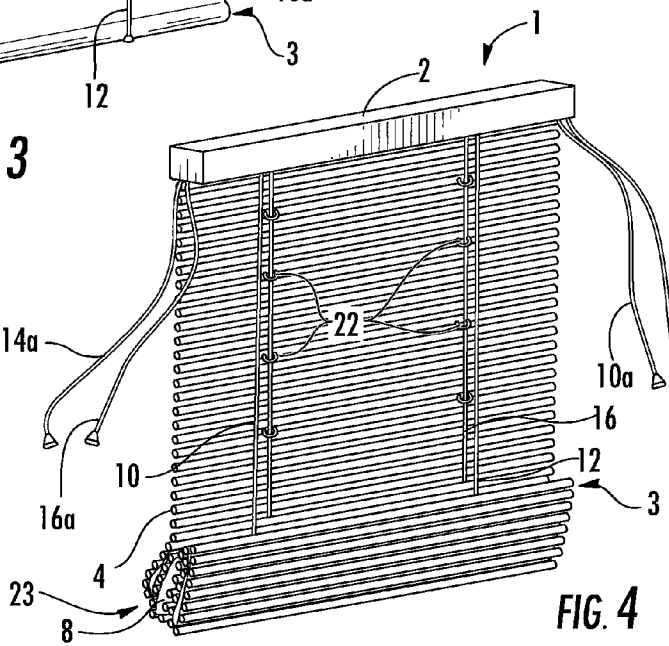
FIG. 4 shows the window covering of FIG. 1 in a second orientation.

To change the light blocking/filtering characteristics of the window covering 1, pull portions 14*a*, 16*a* are manipulated to lengthen the lift cords 14, 16 and lower the midpoint P of the shade. The pull portions 10*a*, 12*a* are then manipulated to shorten the lift cords 10, 12 and raise the bottom of the shade as shown in FIG. 4. In this position the portion of panel 4 without second panel 8 is located over the window or other architectural feature. The light filtering or light blocking characteristics of the window covering 1, when in this position, is the same as that provided by a standard woven shade and is different than the light blocking characteristics of the shade when in the position of FIG. 3. In this position pleats 23 are formed in panel 4 and second panel 8 near the bottom of the window covering remote from head rail 2.

Figure 5:
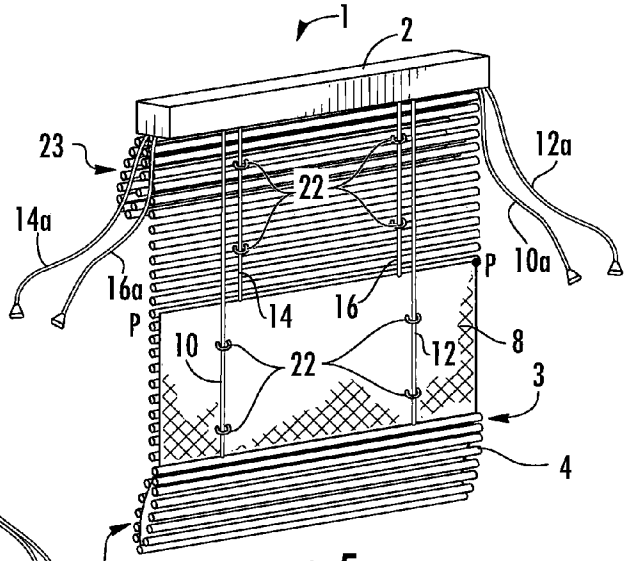
FIG. 5 shows the window covering of FIG. 1 in a third orientation.

Similarly the pull portions 14*a*, 16*a* and 10*a*, 12*a* can be manipulated such that both the lower edge 3 and midpoint P of panel 4 are located in positions between the completely raised and completely lowered positions. Such a position is shown in FIG. 5 where the lower edge 3 of the panel 4 and the midpoint P of panel 4 are both partially raised. In this position, a portion of panel 4 with second panel 8 and a portion of panel 4 without second panel 8 is located over the window or other architectural feature. The light filtering or light blocking characteristics of the window covering 1, when in this position, allows a combination of the light blocking/filtering characteristics of the shade to be used. In this position folded pleats 23 are formed at both the top and the bottom of the window covering.

Figure 6:
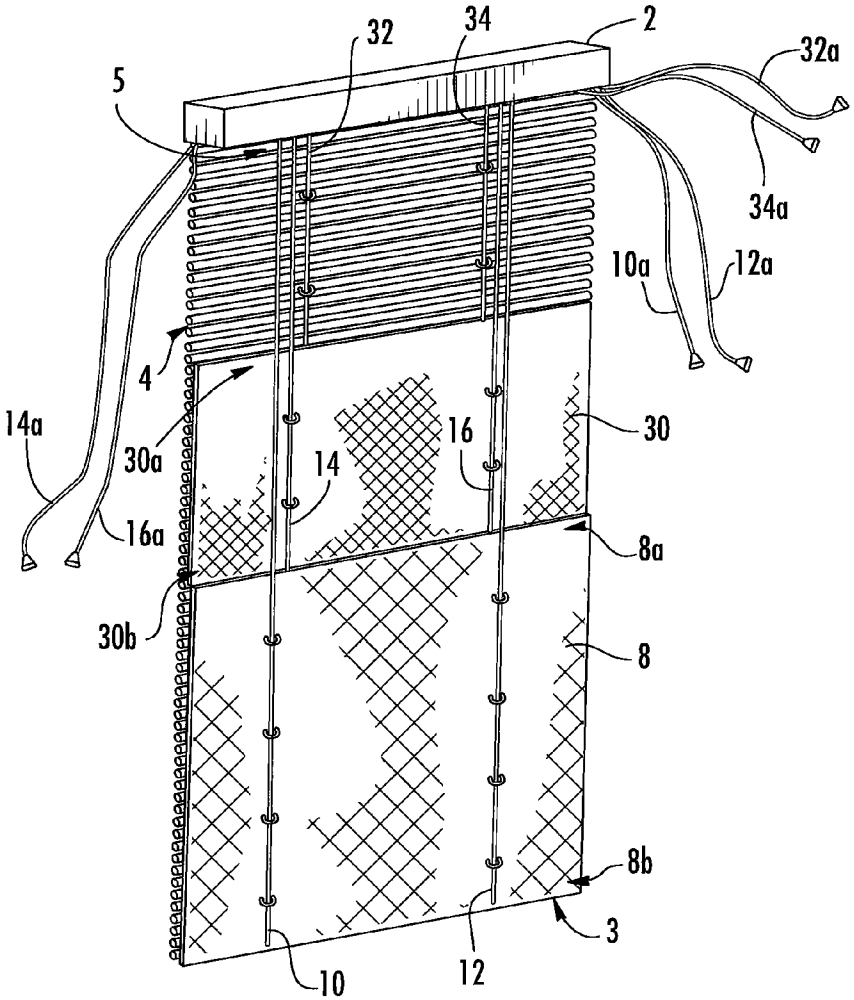
FIG. 6 is a back perspective view of another embodiment of the window covering of the invention.

The second panel 8 is shown to be coextensive with approximately half of the shade panel 4; however, panel 8 may extend over more or less of the shade panel. Further, a third panel 30 may be provided, as shown in FIG. 6 where the third panel provides light blocking/filtering characteristics different than the second panel 8. Fifth and sixth lift cords 32 and 34 are provided and form pull cord portions 32*a* and 34*a* that can be manipulated by the user to raise and lower panel 4 at the upper edge 30*a* of panel 30 as previously described with respect to cords 10, 12, 14 and 16. In the illustrated embodiment the third panel 30 extends from the upper edge 8*a* of the second panel 8 to a point on the panel 4 spaced from the upper edge 5 of panel 4 to create three zones of varying light blocking characteristics rather than the two zones created in the embodiment of FIGS. 1 through 5. The lower edge 30*b* of panel 30 may also be spaced from the upper edge 8*a* of the second panel 8. Further, the upper edge 30*a* of panel 30 may extend to the upper edge 5 of panel 4 to create two zones of varying light blocking characteristics where each zone includes panel 4 and a second layer, either layer 8 or layer 30.

Figure 7:
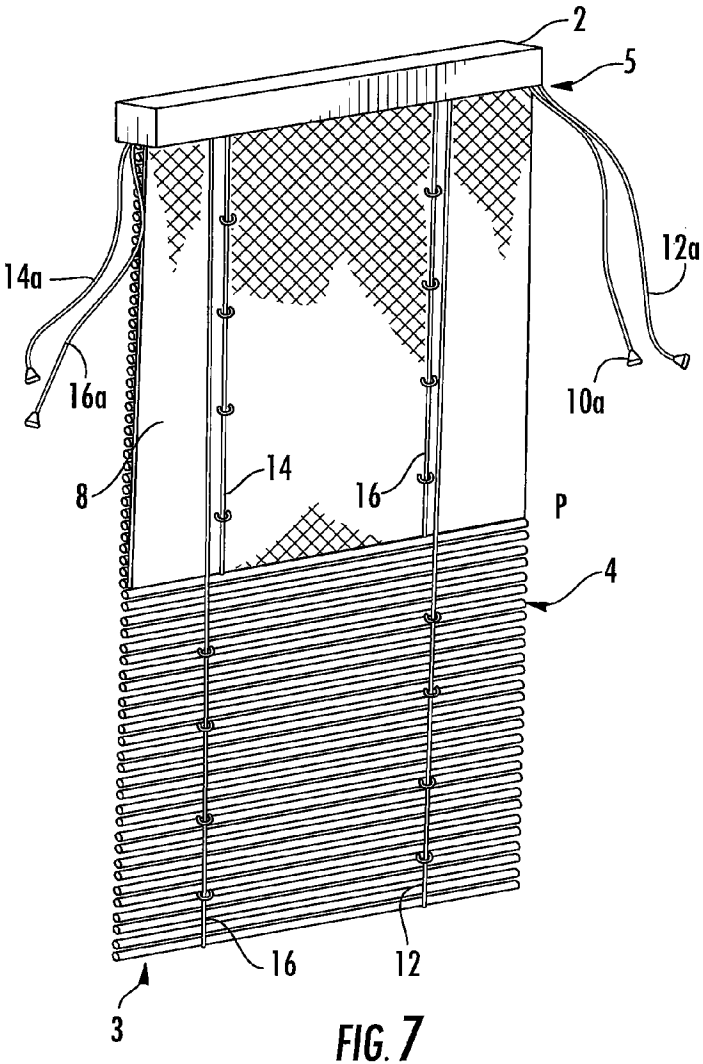
FIG. 7 is a back perspective view of yet another embodiment of the window covering of the invention.

The second panel 8 may also extend from the top edge of panel 4, adjacent head rail 2, to the mid-point P as shown in FIG. 7 such that the light blocking/filtering characteristics of the second panel 8 are utilized on the top portion of the window covering.

It is to be understood that the panels 8 and 30 have light blocking and/or light filtering characteristics that change the light that passes through the window covering when compared to the panel 4 alone. The ability of the panels 8 and 30 to filter and/or block light is referred to herein as light blocking characteristics. The panels 8 and 30 may be made of a tightly woven fabric, a polymer sheet or other flexible member that alters the characteristic of light as it passes through the window covering. For example the panels 8 and 30 may filter some portion of or substantially all of the light passing through the window covering or panels 8 and 30 may change the color of the light passing through the window covering or otherwise alter the light passing through the window covering. Further, the panels 8 and 30 may be made of more than one layer of material to achieve the desired light blocking characteristic.

While the system for raising and lowering the lift cords 10, 12, 14, 16, 32 and 34 has been described as a manual system where the user manually manipulates the exposed pull cord portions of the lift cords, the lift cords may be raised and lowered using other means. For example, an electric motor may be used to raise and lower the lift cords. The electric motor may be powered by a battery and controlled by a remote control using an infrared signal or the like. The electric motor may be located in or on the head rail and connected to the lift cords through a pulley system or other transmission system. Additionally, spring motors may be used to raise and lower the lift cords. Spring motors comprise a plurality of spools around which the lift cords are wrapped. A spring is operatively connected to the spools and stores energy when the window covering is lowered (the lift cords are extended). A user may push on the panel 4 to raise and lower the panel. The spring motor assists in the raising of the panel and holds the panel in the desired position when the user stops applying a force to the window covering. Other mechanisms for raising and lowering the panel may also be used.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A window covering comprising:

a flexible panel having an upper edge and a lower edge, said upper edge being adjacent to a head rail;

a second panel at least partially coextensive with the flexible panel and having a second upper edge and a second lower edge, said second upper edge being connected to said flexible panel at a midpoint of the flexible panel;

a first lift cord for raising the lower edge of the flexible panel and the second lower edge of the second panel to create first folded pleats remote from the head rail; and a second lift cord for raising the second upper edge of the second panel and the midpoint of the flexible panel to create second folded pleats adjacent the head rail.

2. The window covering of claim 1 wherein the flexible panel is a woven panel.

3. The window covering of claim 2 wherein the woven panel comprises a plurality of horizontal members woven together.

4. The window covering of claim 1 further including a third lift cord for raising the flexible panel and a fourth lift cord for raising the second panel.

5. The window covering of claim 1 wherein said second lower edge being connected to said lower edge.

6. The window covering of claim 1 wherein a first plurality of rings are provided between the upper edge of the flexible panel and the midpoint, said second lift cord extending through said first plurality of rings and a second plurality of rings are provided between the midpoint and the second lower edge, said first lift cord extending through said second plurality of rings.

7. The window covering of claim 1 wherein said first and second lift cords extend from the head rail to create first and second pull cords.

8. The window covering of claim 1 further comprising:

a third panel at least partially coextensive with said second panel and having a third upper edge; and a third lift cord for raising the third upper edge of the third panel.

9. The window covering according to claim 8 wherein the second panel has a first light blocking characteristic and the third panel has a second light blocking characteristic.

10. The window covering of claim 1 wherein the flexible panel is a Roman shade.

11. The window covering of claim 1 wherein the flexible panel is a hobbled shade.

12. The window covering of claim 1 wherein the flexible panel is a looped shade.

13. The window covering of claim 1 wherein the second panel is located on the back of the flexible panel.

14. The window covering of claim 1 wherein the second panel is completely light blocking.

15. The window covering of claim 1 wherein the second panel is partially light blocking.

16. The window covering of claim 1 wherein the second panel is light filtering.

17. The window covering of claim 1 wherein the first lift cord is connected adjacent to one of the lower edge of the flexible panel and the second lower edge of the second panel bottom.

18. The window covering of claim 1 wherein the first lift cord is connected to a bottom rail.

19. The window covering of claim 1 further including a rail at said midpoint.

20. A window covering comprising:

a flexible panel having an upper edge and a lower edge, said upper edge being adjacent to a head rail;

a second panel at least partially coextensive with the flexible panel and having a second upper edge and a second lower edge, said second lower edge being connected to said flexible panel at a midpoint of the flexible panel;

a first lift cord for raising the lower edge of the flexible panel to create first folded pleats remote from the head rail; and a second lift cord for raising the second lower edge of the second panel and the midpoint of the flexible panel to create second folded pleats adjacent the head rail.

21. The window covering of claim 20 wherein the flexible panel is a woven panel.

22. The window covering of claim 21 wherein the woven panel comprises a plurality of horizontal members woven together.

23. The window covering of claim 20 further including a third lift cord for raising the flexible panel and a fourth lift cord for raising the second panel.

24. The window covering of claim 20 wherein a first plurality of rings are provided between the upper edge of the flexible panel and the midpoint, said second lift cord extending through said first plurality of rings and a second plurality of rings are provided between the midpoint and the second lower edge, said first lift cord extending through said second plurality of rings.

25. The window covering of claim 20 wherein said first and second lift cords extend from the head rail to create first and second pull cords.

26. The window covering of claim 20 wherein the second panel is completely light blocking.

27. The window covering of claim 20 wherein the second panel is partially light blocking.

28. The window covering of claim 20 wherein the second panel is light filtering.

29. The window covering of claim 20 wherein the first lift cord is connected to a bottom rail.

30. The window covering of claim 20 further including a rail at said midpoint.

* * * * *